US006009639A

United States Patent [19]

Donnadieu et al.

[11] Patent Number: 6,009,639

[45] **Date of Patent: *Jan. 4, 2000**

[54] SPORT BOOT INCORPORATING A FLEXIBLE COLLAR WITH DAMPING SUPPORT ZONE

[75] Inventors: Thierry Donnadieu, Poisy; Francis Repellin, Villard de Lens, both of France

[73] Assignee: Salomon S.A., Cedex, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,722

[22] Filed: Mar. 20, 1997

[30] Foreign Application Priority Data

Mar. 25, 1996 [FR] France ..... 96 03918

[51] Int. Cl.[7] ..... A43B 5/04; A43B 23/26; A43B 23/07

[52] U.S. Cl. ..... 36/118.2; 36/54; 36/55

[58] Field of Search ..... 36/54, 55, 117.1, 36/117.2, 118.2, 119.1

[56] References Cited

U.S. PATENT DOCUMENTS

| | | | |
|---|---|---|---|
| 3,969,833 | 7/1976 | Vaccari | 36/119.1 |
| 4,391,049 | 7/1983 | Parisotto | 36/54 |
| 5,175,948 | 1/1993 | Tonel et al. | 36/119.1 |
| 5,499,461 | 3/1996 | Danezin et al. | 36/119.1 |
| 5,519,951 | 5/1996 | Paris | 36/119.1 |
| 5,575,091 | 11/1996 | Mattiuzzo | 36/118.2 |
| 5,647,150 | 7/1997 | Romanato et al. | 36/117.1 |
| 5,901,470 | 5/1999 | Begey | 36/118.2 X |
| 5,903,984 | 5/1999 | Donnadieu et al. | 36/118.2 X |

*Primary Examiner*—B. Dayoan
*Attorney, Agent, or Firm*—Pollock, Vande Sande & Amernick

[57] ABSTRACT

The sport boot has a relatively rigid collar surmounting an upper and whose rearward pivoting motion is restricted. A damping support zone matches up with the rear part of the wearer's lower leg and has gradually-increasing flexibility by virtue of the combined use of a flexible vertical tongue and elastic padding on a portion of the rear upper edge of the collar.

9 Claims, 3 Drawing Sheets

SPORT BOOT INCORPORATING A FLEXIBLE COLLAR WITH DAMPING SUPPORT ZONE

FIELD OF THE INVENTION

The present invention concerns sport boots incorporating a relatively rigid collar, for example one made of a plastic material, which surmounts an upper and whose rearward pivoting motion is restricted; in particular, it relates to a collar provided with a damping support zone positioned so as to match up with the posterior part of the wearer's lower leg.

BACKGROUND OF THE INVENTION

Some conventional sport boots of this type, such as cross-country ski boots designed for skating, comprise a collar whose rearward pivoting motion can be restricted by elastic means which counter this motion by virtue of a sliding linkage possessing limited spring movement and centered on the collar joint, by holding the collar in place on the front part of the upper when this collar is closed, or simply by stopping the collar on the heel of the upper. To ensure the wearer's comfort, a transverse slot, or notch in the shape of a "U" open at the top, is produced in the rear of the collar and on a portion of its upper edge, and a padding element which extends to a relatively degree beyond this edge is arranged on the inner surface of the collar. In this way, when the collar reaches its limiting rearward pivoting position or in the event of hyperextension of the leg, the posterior part of the lower leg, and in particular the Achilles tendon, may still bend backward by a determinate amplitude. This configuration prevents the impact effect that may occur between the posterior part of the lower leg and the top of the plastic collar. In these boots, the padding element is covered, in conventional fashion, by a woven and/or jersey fabric, this covering being most often differentiated into the outer, visible side of the boot and the inner side, which is in contact with the lower leg. In fact, differentiated parts are normally joined on the periphery of the padding and are conventionally connected by stitching which extends in a plane transverse to the vertical axis of the collar. The configurations imparted to the rear upper edge of the collar and padding are provided to avoid overly firm, abrupt contact between the posterior part of the lower leg and the peripheral edge of the collar, when the wearer's movement causes his foot to be extended, or even hyperextended.

However, these conventional configuration do not prove completely satisfactory, since there remain points and/or lines of contact at the spot where the padding element and the upper edge of the rigid plastic collar meet. Furthermore, when the padding element incorporates a sewn covering, the stitching itself impedes any potential deformation of the padding and forms a contact line which the wearer finds painful. Indeed, these problems arise mainly from the significant reduction of the contact surfaces between the posterior part of the lower leg and the collar, which occurs when the foot is extended at the same time that the collar is prevented from following this rearward motion. As a result, the contact surfaces decrease in size when the lower leg extends, in a rearward supported position, toward the stitching and/or at the point of junction between the padding element and the peripheral edge of the collar. Thus, for a given stress, a significant increase of pressure tends to become localized along these spots, which form lines of contact, the effect of which on the lower leg is equivalent to that of a string pulled taut.

SUMMARY OF THE INVENTION

The present invention represents an attempts to solve these comfort problems by avoiding the localization of pressures along a line or edge, and, in particular, suggests damping the contact between the posterior part of the lower leg and the rear part of the collar when the foot is extended and distributing the forces over a surface which remains relatively large even when the collar reaches its limiting rearward pivoting point, and which gradually becomes deformed.

To achieve these objectives, the sport boot having a relatively rigid collar, for example a collar made of plastic, which surmounts an upper incorporates a damping support zone located in an area matching up with the posterior part of the wearer's lower leg, in particular of the Achilles tendon, and is characterized by the fact that the support zone possesses gradually-increasing flexibility obtained by virtue of a flexible vertical tongue extending upward and over a portion of the rear upper edge of the collar and of an elastic padding element matching up with the inside of the collar, this element extending substantially beyond the rear upper edge of this collar.

By means of this configuration, the combination of the flexible tongue and the elastic padding element enables these members to work together in perfect synergy, even though there is no necessary linkage between them and without impediment when they are subjected to a rearward deformation of the boot.

It will be seen, for example, that they are not hindered by transverse stitching and that, as configured, they incorporate no contact edge or line at which the forces could be localized to the point that the support zone is rendered painful. In fact, since the peripheral edge of the collar is constituted, in the support zone, by the periphery of the flexible tongue, flexion of this tongue simultaneously moves this edge away in the same direction as the direction of flexion.

Depending on the desired resistance to flexion and, in particular, to reduce this resistance, the vertical tongue is provided with at least one transverse slot designed to weaken it.

When several transverse slots are arranged in succession one above the other, these slots weaken the tongue over a determinate length and also make it possible to modify the progressive nature of the resistance of this tongue, depending on the degree to which these are spaced apart and/or on their widths. These slots may obviously be of differing, e.g., decreasing, lengths.

According to one embodiment, the tongue possesses a certain width at its base, which narrows gradually as it extends upward toward its free end. By virtue of this configuration, the flexion-resistance of the tongue in the longitudinal axis of the boot is made to decrease progressively from its base to its free end. In this structure, the transverse slots then preferably incorporate decreasing lengths from the base of the tongue to its free end, in order to preserve the gradual nature of their resistance to flexion of this tongue.

According to another embodiment, the elastically-deformable padding element located in a position matching that of the tongue belonging to the collar is connected laterally to other padding elements possessing different characteristics, by means of stitching extending substantially vertically and placed on either side of this tongue. In this way, the padding can be deformed toward the rear of the boot, without being hindered by the stitching in the covering. Furthermore, this embodiment allows the use of lateral padding elements possibly possessing different characteristics; that is, they may be non-elastic, heat-adaptable, adjustable by injection or molding, thermoformed, etc. This possibility proves advantageous, especially as regards the lateral areas of the foot articulation, where it is desirable that, while providing a degree of comfort when in contact with the foot, the padding elements, also ensure adjustment and maintenance of adjustment to the morphology of this articulation, without exerting any continuous pressure which might be painful, for example in the area of the malleoli.

According to one improvement, the elastic padding element is loosened when the boot is ready to be put on, the foot being inserted and held in the boot. For example, the padding element is made larger than the length of the posterior part of the lower leg it is intended to enclose, and/or incorporates several undulations or folds facilitating its radial deformation.

According to a preferred embodiment, a flared notch open at the top and substantially U-shaped is produced on a portion of the rear upper edge of the collar and contains the flexible tongue, at least in part vertically and completely in its transverse dimension. Obviously, the notch may be of varying width and flared, and, accordingly, its edges may extend to the sides of the collar. It is evident that the notch may also be asymmetrical in shape, in particular when the collar is asymmetrical, and, accordingly, that its upper edge extends higher on one side than on the other.

BRIEF DESCRIPTION OF THE DRAWINGS

The characteristics and advantages of the invention will be better understood by referring to the following description provided with reference to the attached drawings illustrating, by way of example, an embodiment of the boot in comparison with two embodiments according to conventional prior art.

In FIG. 3, the rear portion of the collar,

In FIG. 4, the side of the collar seen in the direction of the arrow "A" in FIG. 3, in FIG. 5, the collar seen from above.

DESCRIPTION OF THE PREFERRED EMBODIMENT

Figure 1:
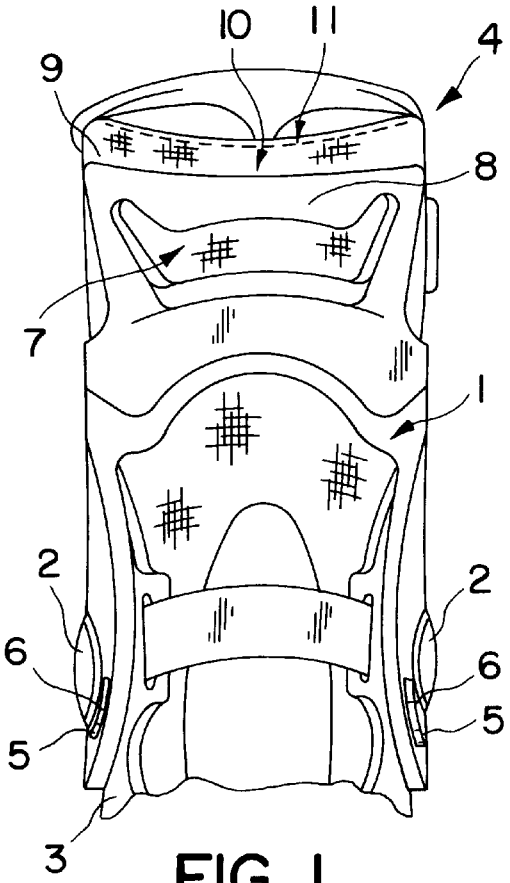
FIG. 1 PRIOR ART
FIGS. 1 and 2 are partial schematic views showing the rear portions of the collars of sport boots according to the state of the art, such as cross-country ski boots designed for skating and comprising a damping support zone, FIGS. 1*a* and 2*a* being partial lateral views of these portions illustrating structural detail.
Figure 1A:
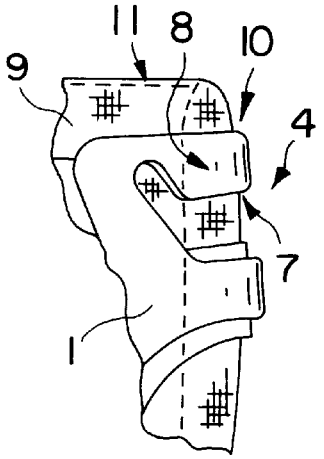
FIG. 1a PRIOR ART

In conventional fashion as shown in FIGS. 1 and 1*a,* the sport boot, in particular a cross-country ski boot, has a plastic collar 1 which, hinged to the upper 2 by connecting pins 2, is provided with damping support zone, indicated by the arrow 4. On each side of the boot, a sliding linkage formed by a slug 5 and a hole 6 centered over the joint 2 restricts the amplitude of the possible spring motion of the collar 1, especially its rearward motion, in order to prevent the skier's foot from becoming hyperextended. For the skier's comfort, the plastic upper 1 is equipped with an internal padding element 9 and, in the rear, incorporates a transverse slot 7 located in its upper edge 8. By virtue of this configuration, the impact effect capable of being generated between the posterior part of the lower leg and the upper edge of the collar 8 is dampened. Indeed, when an impact or stress is generated on the edge 8, the latter bends because of elastic deformation at the site of the transverse slot 7 and thus dampens the impact. However, this configuration allows a line of contact 10 to remain at the spot where the padding element 9 and the upper edge 8 meet. Moreover, when, in conventional fashion, the padding element 7 is covered with a sewn fabric on its periphery, the stitching 11 itself constitutes another painful line of contact. Again, the since virtually all of the comfort-producing elements are made from soft materials possessing relatively minimal elastic elongation properties, the comfort element 7 effectively absorbs the impact partially, but also hinders elastic deformation of the edge 8 of the collar 1.

Figure 2:
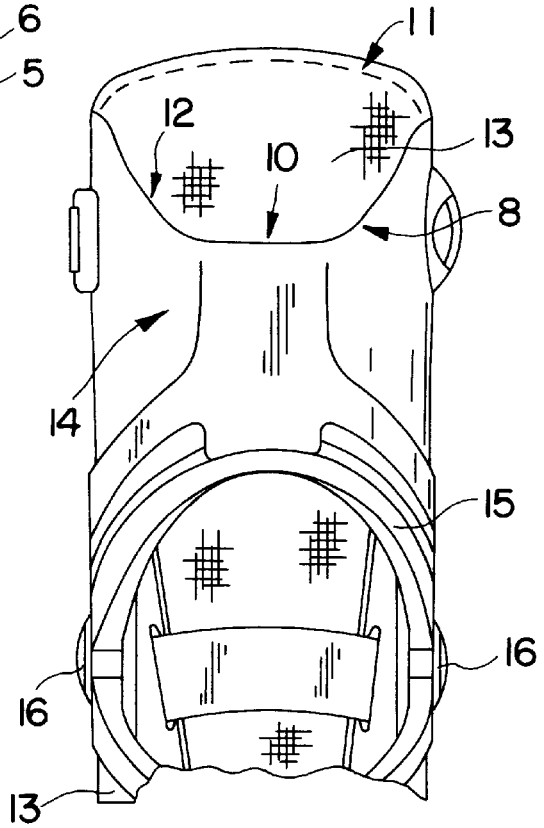
FIG. 2 PRIOR ART
Figure 2A:
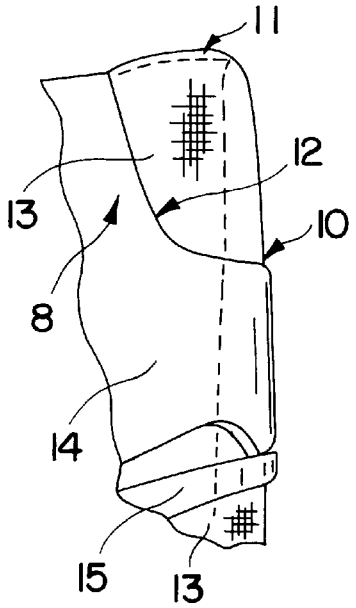
FIG. 2a PRIOR ART

Still in accordance with the state of the art and as illustrated in FIGS. 2 and 2*a,* one conventional sport boot designed for cross-country skiing incorporates, on the rear portion of its plastic collar 14 and over a portion of its upper edge 8, a wide cut-out part 12 open at the top, and which is closed using a pliable and/or elastic padding element 13. The collar 14 is connected-jointed to the upper 13 by means of pins 16, and its rearward pivoting motion is restricted by elastic means 15 which interact between the collar 14 and the upper 13. In this configuration, when the rearward pivoting motion of the collar 14 is stopped, the posterior part of the lower leg comes to be supported initially on the padding element 13, which is deformed rearward, and then on the upper edge 8 of the collar 14, which is delimited at this spot by the contour of the cut-out part 12. As before, comfort problems arise from the localization of forces along a line of contact, which is constituted by the stitching 11, and along the line of contact 10, which, in this case, is given material form by the contour of the cut-out part 12 where the upper edge 8 of the collar 14 and the padding element 13 meet.

Figure 3:
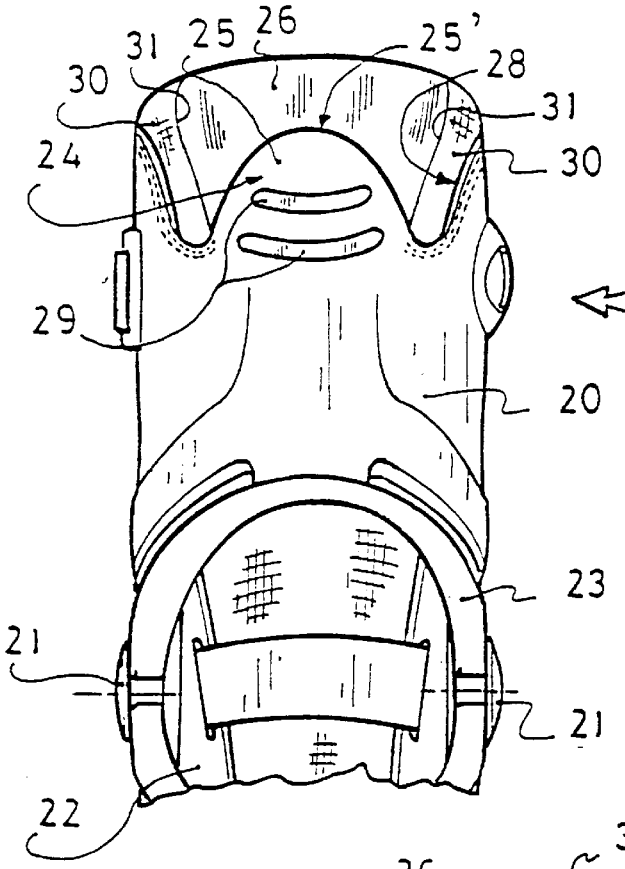
FIGS. 3, 4, and 5 are partial views of a sport boot comprising a damping support zone according to the invention and illustrating.
Figure 4:
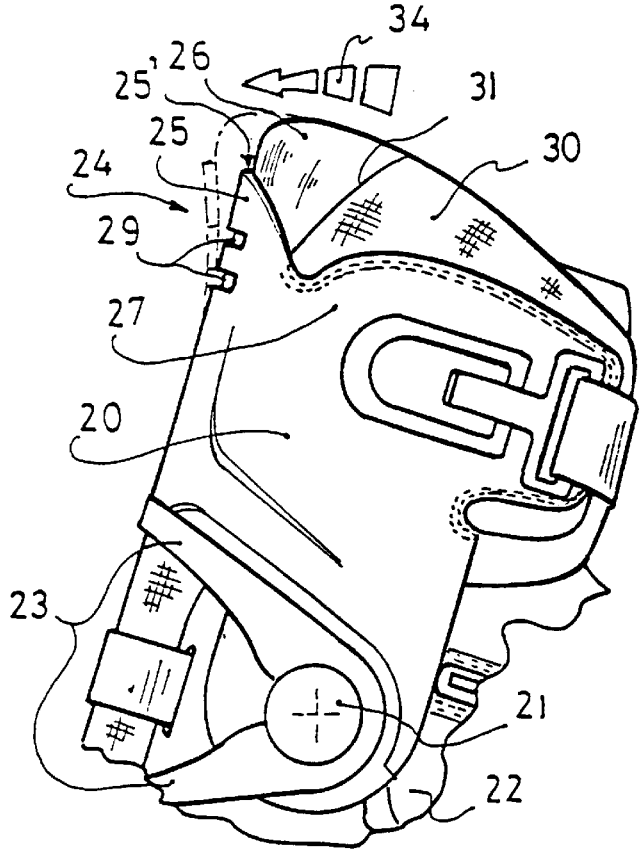
Figure 5:
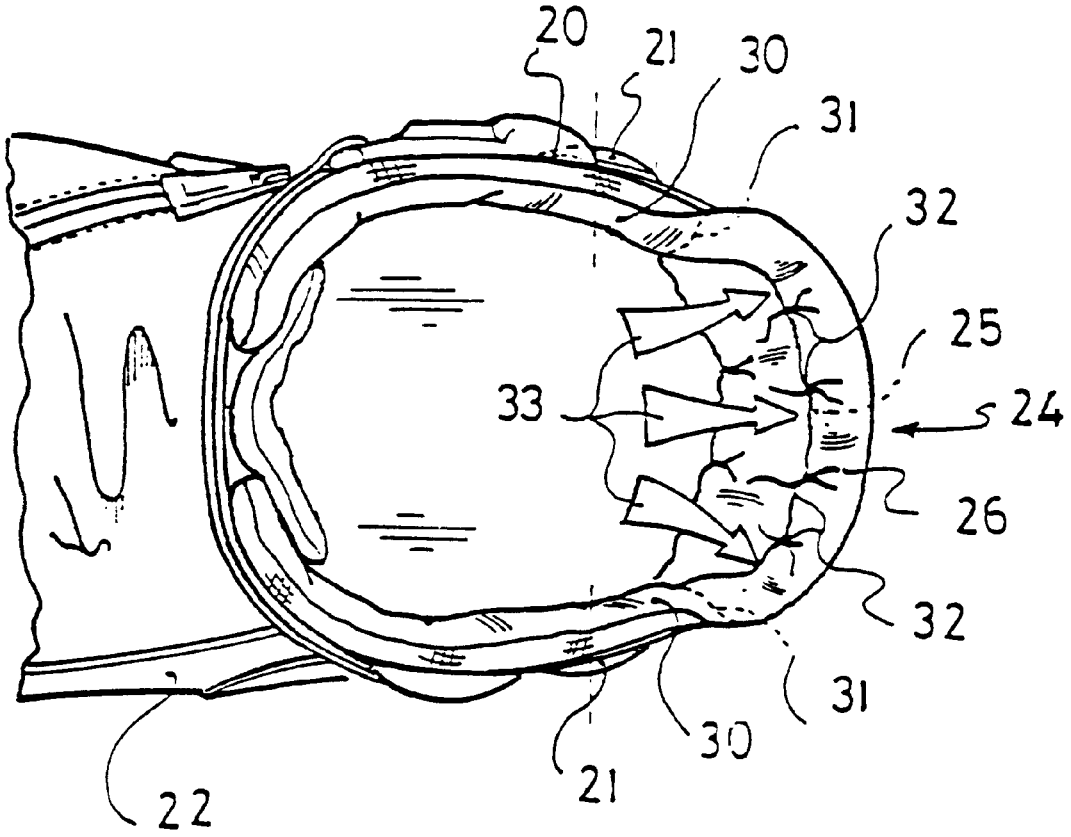

FIGS. 3, 4 and 5 illustrate, partially and by way of example, a sport boot comprising an impact-damping support zone which, in accordance with the invention, proves a simple, effective solution to the problems just mentioned. This sport boots has a plastic collar 20 connected by joints 21 to an upper 22. The rearward pivoting motion of this collar is limited by elastic means existing as a ring, which, when interposed between the collar 20 and the upper 22, elastically counters this pivoting motion from a determinate rearward position, which most often corresponds to the so-called "wearer's ankle-reference" position; that is, when the plane of the sole of the foot is perpendicular to the axis of the lower leg. The collar 20 is provided with an impact-damping support zone 24 matching up with the posterior part of the lower leg (not shown). This support zone 24 incorporates gradually-increasing flexibility by virtue of the combination of a flexible vertical tongue 25 having a special structure and an elastic padding element 26, which are placed in corresponding positions to each other. To ensure comfort, the padding element 26 extends substantially beyond the upper edge 27 of the plastic collar 20. Advantageously, this edge 27 incorporates a U-shaped indentation 28 flared toward the top, inside of which the vertical tongue 25 is positioned at least in part vertically and completely in its transverse dimension.

To provide progressive elastic resistance, the vertical tongue 25 narrows at the top; that is, it has a determinate width at its base, which, in this example, is substantially equal to the width of the bottom of the indentation 28 and which gradually narrows as its extends toward the free end 25'. In addition, to weaken the tongue 25, thus making it more flexible, transverse slots 29 arranged one above the other are cut in the tongue. To retain a degree of gradually-increasing flexibility, these slots 29 may possess decreasing lengths matching the decreasing width of the tongue 25.

In this embodiment, the elastic padding element 26 is connected laterally to lateral padding elements 30 by means of stitching 31 extending substantially vertically on either side of the tongue 25. This arrangement makes it possible to use padding elements 30 which are not basically elastic, but better adapted to the morphology of the ankle joint of the wearer, but without impairing or hindering the flexibility of the rear support zone 24 in the anterior-posterior direction shown by arrow 34 in FIG. 4.

According to one construction detail, the elastic padding element 26 is configured to be in the loosened position when the boot is ready to be put on; to that end, it incorporates several vertical folds or undulations 32 which facilitate its radial deformation, as indicated by the arrows 33 in FIG. 5.

Of course, the boot may be produced so as to incorporate a collar made integral with the upper, and thus without any pivoting joint or linkage, and in any other material besides plastic, while remaining within the scope of the invention.

Again, the elastic padding element 26 combined with the tongue 25 is not necessarily combined with other padding elements.

Finally, the elastic padding element 25 may incorporate various contours whether gradually increasing or not increasing beginning at its base, and the upper edge 27 of the collar 20 may incorporate an asymmetrical indentation 28.

It is obvious that the elastic padding element 26 is preferably designed to be elastically elongated to a degree at least equivalent in amplitude to the maximum flexion to which the tongue 25 may be subjected.

What is claimed is:

1. A sport boot comprising a collar surmounting an upper, said collar comprising an impact-damping support zone matching up with a rear part of a lower leg of a wearer, wherein the support zone has a gradually-increasing flexibility produced by a vertical tongue having gradually increasing flexibility in a vertical direction extending over a portion of a rear upper edge of the collar and upward, so as to obviate formation of a line of contact between said lower leg and said rear upper edge of said collar, and by an elastic padding element placed in a corresponding position on an inside of the collar, said padding element extending substantially beyond said rear upper edge of said collar.

2. The sport boot according to claim 1, wherein the vertical tongue is provided with at least one transverse slot.

3. The sport boot according to claim 1, wherein the tongue has a base determinate width which narrows progressively as it extends upward to its free end.

4. The sport boot according to claim 2, wherein the tongue comprises transverse slots having decreasing lengths from a base of the tongue to its free end.

5. The sport boot according to claim 1, wherein the elastically-deformable padding element is joined laterally connected to other padding elements having different properties by means of stitching directed substantially vertically and located on either side of the tongue.

6. The sport boot according to claim 1, wherein the elastic padding element is loosened when the boot is ready to be put on.

7. The sport boot according to claim 6, wherein the elastic padding element incorporates a plurality of vertical undulations facilitating radial deformation of said padding element.

8. The sport boot according to claim 1, wherein a flared, substantially U-shaped indentation open at the top is provided on a portion of the rear upper edge of the collar and encloses the flexible tongue at least in part vertically, and completely in its transverse dimension.

9. The sport boot according to claim 8, wherein the edges of the indentation extend up to the sides of the collar.

* * * * *